US005310409A

United States Patent [19]

Friday

[11] Patent Number: 5,310,409

[45] Date of Patent: May 10, 1994

[54] METHOD FOR ALTERING FABRICS OR GARMENTS TO DISCHARGE DYED COLORS OR INDIGO DENIM TO CREATE FINISHES

[76] Inventor: James I. Friday, 9 Dorchester Dr., Chesnee, S.C. 29323

[21] Appl. No.: 676,386

[22] Filed: Mar. 18, 1991

[51] Int. Cl.[5] ..... D06M 3/06; D06M 3/08

[52] U.S. Cl. ..... 8/102; 8/107; 8/108.1; 8/114; 8/115

[58] Field of Search ..... 8/101, 102, 111, 114, 8/115, 483, 108.1, 107

[56] References Cited

U.S. PATENT DOCUMENTS

| | | | |
|---|---|---|---|
| 852,693 | 5/1907 | Babbe et al. | 427/282 |
| 1,436,423 | 11/1922 | Wood | 427/272 |
| 1,588,951 | 6/1926 | Dreyfus | 8/115 |
| 4,224,358 | 9/1980 | Hare | 427/147 |
| 4,322,213 | 3/1982 | Tappe et al. | 8/449 |
| 4,480,362 | 11/1984 | Maxwell | 26/28 |
| 4,600,406 | 7/1986 | Corte | 8/108 R |
| 4,740,213 | 4/1988 | Ricci | 8/108.1 |
| 4,765,100 | 8/1988 | Majors | 51/313 |
| 4,783,193 | 11/1988 | Pensa | 8/102 |
| 4,790,950 | 12/1988 | Hutchings | 252/102 |
| 4,852,990 | 8/1989 | Patterson | 8/108.1 |
| 4,863,775 | 9/1989 | Jacobs et al. | 428/91 |
| 4,900,323 | 2/1990 | Dickson et al. | 8/111 |
| 5,154,728 | 10/1992 | Craven et al. | 8/115 |

*Primary Examiner*—Prince Willis, Jr.
*Assistant Examiner*—Alan D. Diamond

[57] ABSTRACT

A discrete, well defined pattern is produced on colored fabric by applying to the desired area of the fabric a viscous mixture of fine mineral particles, water and one or more bleaching agents. The viscous mixture remains confined to the designated area and permeates the fabric. After a controlled, finite period of time, the mixture is rinsed away, leaving a well defined area from which the fabric coloration has been removed.

15 Claims, No Drawings

METHOD FOR ALTERING FABRICS OR GARMENTS TO DISCHARGE DYED COLORS OR INDIGO DENIM TO CREATE FINISHES

SUMMARY OF THE INVENTION

The present invention is directed to a method for producing a desired design on the surface of a colored fabric by discretely removing coloration from a specific defined area on the fabric. More specifically the present invention is directed to a method for producing a design on the surface of fabric by removing coloration from a specific area of the fabric using a viscous mixture of fine sand or other abrasive material, water and one or more bleaching compounds selected from sodium hypochlorite and sodium bromite.

BACKGROUND OF THE INVENTION

Various techniques are known and employed for producing patterns or designs on fabric. In some instances these procedures have involved processes similar to printing in which ink or dyestuff is applied to the surface of the fabric. It is also known to produce a worn appearance, particularly with denim material by abrading the material or generally applying bleaching compounds in a random manner to articles of clothing made from the material in order to realize the desired effect. In the case of applying a dye to fabric to produce a design or pattern, it is usually necessary that the fabric substrate be of a relatively light color in order to obtain contrast between the fabric and the dye. In the case of techniques that are used for abrading or producing a worn affect using various bleaches, application is made to the entire piece of fabric which is frequently in the form of a prepared piece Of clothing with the result that the random appearance that is obtained is distributed throughout the garment.

THE PRIOR ART

U.S. Pat. No. 4,740,213 to Ricci describes a process for fading whole garments in a tumbler by bringing it into dry contact with Pumice impregnated with a bleaching agent.

U.S. Pat. No. 4,600,406 to Corte describes a method for bleaching textile materials in water using a combination of bromide and chlorine ions.

U.S. Pat. No. 4,783,193 to Pensa describes a composition for use in a process for stripping color from synthetic polymer material using various bleaching and chemical agents.

U.S. Pat. No. 4,765,100 to Major describes a method of stone washing articles of clothing using an abrasive member and a tumbler.

U.S. Pat. No. 4,863,775 to Jacobs et al describes a process for producing a desired finish on denim fabric in which the fabric is abraded and treated with various chemicals.

U.S. Pat. No. 4,852,990 to Patterson describes a process for bleaching fabrics and garments made of denim using a polyacrylic acid and then a bleaching agent in an aqueous bath.

U.S. Pat. No. 4,480,362 to Maxwell describes a fabric abrasion process in which the fabric is passed by rollers over an abrading element.

The prior art has not however suggested a technique for producing desired designs on fabric such as denim in which the coloration of the denim fabric is selectively removed in a controlled manner from a discrete area to produce a well defined pattern.

Accordingly it is an objective of the present invention to provide a process for producing a desired design on fabric material, particularly fabric having a dark color, which does not require heat to discharge the color from the fabric and in which the depth of removal of the color of the fabric can be controlled.

DETAILED DESCRIPTION OF A PREFERRED EMBODIMENT OF THE INVENTION

In accordance with the present invention a procedure is provided for producing a desired design or image on fabric such as denim or other fabric having a generally dark background coloration in which the coloration of the fabric is destroyed in a controlled manner and in a discrete, well defined area by application of a viscous mixture of fine, inert mineral material, water and a combination of bleaching components such as sodium hypochlorite and sodium bromite. According to the invention, a viscous mixture having approximately the viscosity of wet mud that it is capable of flowing onto the fabric and impregnating the material is prepared by mixing together about 50% to 75% by weight of a fine, granular, inert mineral material such as fine sand or pumice together with 50% to 25% by weight of an aqueous solution of water and 2 to 20 weight percent of at least one of sodium hypochlorite and sodium bromite. The granular, inert material used in the invention functions as a carrier and viscosity control agent and should be sufficiently fine to form a mud like mixture with water. Typically the mineral material has a grain size of fine sand 0.25–0.125 mm and 0.125–0.0625 mm thus generally ranges from 0.25 to 0.0625 mm in size. While the sodium hypochlorite and sodium bromite bleaching components may be present in approximately equal proportions, this is not necessary in accordance with the present invention so long as at least a minimal amount of one of the components is present. The actual proportions of sand and aqueous solution which are mixed together to form the treating agent of the present invention will depend upon a number of factors including the type of fabric and its porosity as well as the length of time which is contemplated for the actual treatment of the fabric to produce the desired design. Where relatively porous fabric having a loose or widely spaced knit is used, a more viscous or thicker mixture can be employed. The mixture should however have a viscosity which is sufficiently fluid to permit the mixture to permeate the fabric so as to carry the bleaching materials with it and effect treatment of the fabric to the desired depth. On the other hand, if the treating mixture is too fluid then it will simply pass through the fabric with an uneven distribution of bleaching components with uneven bleaching results being obtained.

Treatment of the fabric in accordance with the invention in order to produce the desired design having a discreet, selected pattern is achieved by applying a stencil or pattern to the surface of the fabric so that contact between the fabric and the treating mixture is limited to the desired area. If the viscosity of the treating mixture is not properly controlled, the mixture will not flow laterally across the fabric and will produce a difuse or ill-defined pattern. If the viscosity of the treating mixture is properly controlled the mixture will flow laterally across the fabric and will be confined within the desired stencil area and will migrate only into the fabric within that stencil area to produce a relatively uniform removal of coloration from the fabric material. The extent of removal of coloration form the fabric is controlled primarily by monitoring the length of time in which the treating material or mixture is allowed to remain in contact with the fabric. Generally, this will range from about ten minutes to one hour although some variations in the time required are to be anticipated. At the conclusion of the desired bleaching procedure, the mixture is either neutralized or removed by flushing with water. In this manner the extent of bleaching is controlled. Thus, it is possible in accordance with the present invention by controlling parameters such as the amount of chemicals bleaching components present in the viscous mixture and the period of time of application, varying degrees of lightness or darkness in a uniform manner can be obtained.

EXAMPLE

The following example of the invention is hypothesized:

A mixture of about 60% by weight very fine sand ranging in size from 0.125–0.0625 mm and 40% by weight of an aqueous solution containing 5% each by weight sodium hypochlorite and sodium bromite was prepared having the consistency and viscosity of fluid mud.

A rectangular piece of blue denim cotton fabric was first washed in water at 120°–140° F., then dried. After pressing the fabric, a stencil was secured with adhesive to the fabric which left exposed only a desired pattern of the fabric to be bleached. The above noted mixture was applied evenly to the exposed fabric area and stencil. After about 30 minutes, cold water was applied for 10 minutes and the mixture and stencil removed to leave a discrete, well defined pattern on the fabric where the blue color of the denim had been uniformly removed.

It will further be appreciated that while a preferred embodiment of the present invention has been described herein for illustrative purposes, other embodiments can of course be carried out within the scope and spirit of the present invention.

What is claimed is:

1. A method for producing a desired design on the surface of colored fabric comprising the steps of;

a.) applying to a discrete, selective area of said fabric, a viscous mixture of fine inert, mineral material, water and one or more compounds selected from the group consisting of sodium hypochlorite and sodium bromite, said viscous mixture comprising about 50 to 75 percent by weight fine sand and 50 to 25 percent by weight of an aqueous solution containing about 2 to 20 weight percent of at least one of said sodium hypochlorite and sodium bromite, b.) allowing said viscous mixture to permeate and remain in contact with said fabric for a sufficient period of time to destroy at least a portion of the coloration present in said fabric, and c.) removing said viscous mixture at the end of said period of time from the fabric to leave a discrete well defined color discharged pattern on the fabric.

2. The method of claim 1 wherein said period of time ranges from about 10 minutes to one hour.

3. The method of claim 1 wherein said period of time ranges from about 30 minutes to one hour.

4. The method of claim 1 wherein said discrete, selective area is defined by a stencil.

5. The method of claim 1 wherein said fabric is denim.

6. The method of claim 1 wherein said removal of viscous mixture is by washing with water.

7. A method for producing a color discharged design on the surface of colored denim fabric comprising the steps of:

a.) securing a stencil forming a design against said colored denim fabric leaving a discrete selective pattern of fabric exposed;

b.) applying to said discrete selective pattern of said denim fabric defined by said stencil, a viscous mixture of 50 to 75 weight percent sand and 50 to 25 weight percent of a 2–10 percent aqueous solution of one or more compounds selected from the group consisting of sodium hypochlorite and sodium bromite;

c.) allowing said viscous mixture to permeate and remain in contact with said denim fabric for about 10 to 60 minutes to destroy at least a portion of coloration present in said fabric;

d.) removing said viscous mixture by washing the viscous mixture from the denim fabric with water; and e.) removing the stencil from the denim fabric to leave a discrete well defined color discharged pattern on the denim fabric.

8. The method of claim 7 wherein said denim fabric has the color blue.

9. The method of claim 7 wherein said washing is for about 10 minutes.

10. The method of claim 7 wherein said sand is quartz.

11. The method of claim 7 wherein said sand is pumice.

12. The method of claim 7 wherein the grain size of said sand ranges from 0.125 to 0.0625 mm.

13. The method of claim 7 wherein the grain size of said sand ranges from 0.25 to 0.125 mm.

14. The method of claim 7 wherein the grain size of said sand ranges from 0.25 to 0.0625 mm.

15. A method for producing a bleached design on the surface of colored blue denim fabric comprising the steps of:

a.) washing a blue denim fabric in water heated at 120°–140° F.;

b.) drying the blue denim fabric;

c.) pressing the blue denim fabric;

d.) securing a stencil to the blue denim fabric forming a design against said colored blue denim fabric leaving a discrete selective pattern of blue denim fabric exposed;

e.) applying to said discrete selective pattern of said exposed fabric defined by said stencil, a viscous mixture of 50 to 75 weight percent sand and 50 to 25 weight percent of a 2–10 percent aqueous solution of one or more compounds selected from the group consisting of sodium hypochlorite and sodium bromite;

f.) allowing said viscous mixture to permeate and remain in contact with said fabric for about 10 to 60 minutes to destroy at least a portion of coloration present in said blue denim fabric;

g.) removing said viscous mixture by washing the viscous mixture from the blue denim fabric with water; and h.) removing the stencil from the blue denim fabric to leave a discrete well defined color discharged pattern on the blue denim fabric.

* * * * *